US005423521A

United States Patent [19]

Stover et al.

[11] Patent Number: 5,423,521

[45] Date of Patent: Jun. 13, 1995

[54] CERAMIC PLUG GAS DISTRIBUTION DEVICE

[75] Inventors: K. Lawrence Stover, New Philadelphia, Ohio; Regis W. Lewis, Butler, Pa.; Todd E. Smith, Dover, Ohio; Ronald T. Snyder, Cabot, Pa.

[73] Assignee: Quigley Company, Inc., New York, N.Y.

[21] Appl. No.: 885,992

[22] Filed: May 19, 1992

[51] Int. Cl.[6] ..... B22D 41/58

[52] U.S. Cl. ..... 266/220; 266/217; 264/59

[58] Field of Search ..... 266/45, 217, 220, 265, 266/266, 268, 270, 44; 264/59; 164/230, 231; 249/83, 175, 177, 178, 179

[56] References Cited

U.S. PATENT DOCUMENTS

| | | | |
|---|---|---|---|
| 3,330,645 | 7/1967 | de Moustier et al. | 75/60 |
| 4,396,179 | 8/1983 | Labate | 266/220 |
| 4,438,907 | 3/1984 | Kimura et al. | 266/217 |
| 4,462,576 | 7/1984 | Hohberg et al. | 266/220 |
| 4,538,795 | 9/1985 | La Bate | 266/220 |
| 4,735,400 | 4/1988 | Tate et al. | 266/270 |
| 4,770,828 | 9/1988 | Rogier et al. | 264/59 |
| 4,913,403 | 4/1990 | Plowman et al. | 266/44 |
| 4,938,461 | 7/1990 | Bertollo | 266/266 |
| 5,104,097 | 4/1992 | Naujokat et al. | 266/217 |
| 5,225,143 | 7/1993 | Labate, II et al. | 266/220 |

FOREIGN PATENT DOCUMENTS

| | | | |
|---|---|---|---|
| 2122532 | 1/1984 | United Kingdom | 264/59 |

*Primary Examiner*—Scott Kastler

*Attorney, Agent, or Firm*—Pennie & Edmonds

[57] ABSTRACT

An insert member including a plurality of strand members having first and second ends and being oriented in a relative spatial relationship representative of a predetermined path, first end portions for mounting the first ends of the strand members and second end portions for mounting the second ends of the strand members, wherein the first and second means are separated by a predetermined distance to provide the predetermined spatial relationship of the strand members. Also, a combination for making a ceramic gas distribution device which includes this insert member and at least one ceramic in an unfired or green state cast partially therearound. The invention also provides methods for making a ceramic gas distribution device by placing a plurality of strand members in a predetermined orientation representative of a plurality of gas passages; casting a first ceramic about the strand members; allowing the cast ceramic to set to an unfired or green state; and firing the ceramic material to a final state while vaporizing the strand material therein to thus provide gas passages therein. The invention also relates to the ceramic gas distribution devices formed by these methods.

37 Claims, 3 Drawing Sheets

CERAMIC PLUG GAS DISTRIBUTION DEVICE

TECHNICAL FIELD

This invention relates generally to device for supplying gas through the wall of a metallurgical container, and more particularly, to an insertable and replaceable ceramic plug member for discretely dividing a flow of gas into a plurality of streams whereby a dispersion of fine bubbles of the gas is injected into molten metal undergoing refinement in a ladle.

BACKGROUND ART

It is common practice in the metallurgical art to utilize injection plug devices to distribute inert gas into molten metal contained in a ladle. Typically, the ladle has a refractory block inwardly adjacent its bottom surface with a central opening in alignment with an opening in the ladle bottom to accommodate insertable registration of a gas injection plug. Such devices are either permeable refractory elements which permit a gas flow to filter through the plug body or solid impervious refractory elements having an array of capillary passages extending through the plug body to conduct a series of discrete gas streams therethrough. U.S. Pat. No. 3,330,645 discloses both the foregoing concepts in one device, utilizing a porous plug material and also providing tubular passageways through the porous body.

Utilization of a solid impervious refractory plug with provision of a peripheral or annular gas flow passage, between the outer surface of the plug and a surrounding metallic sleeve, has been found to have certain distinct advantages. A solid plug has much greater strength and erosion resistance as compared to a porous plug, and the maintenance of continuous open flow conditions is greatly improved. U.S. Pat. Nos. 4,396,179 and 4,538,795 disclose plug structures which utilize a solid refractory core within a surrounding shell spaced from the outer surface of the core to provide a concentric passageway for delivering gas into the molten metal within a ladle, and the advantages of such structures are explained in these patents. A variation of the foregoing concept is found in U.S. Pat. No. 4,462,576 which teaches the provision of a fibrous permeable ceramic layer concentrically located between the outer surface of a frusto-conical solid refractory plug and a surrounding metal jacket.

Another development is the provision of a gas injection plug device wherein channels are preformed in the lateral surface of a solid refractory plug and a properly sized metallic sleeve or canister is positioned about the plug in a heated condition and allowed to cool and shrink tightly to the plug body, thereby closing over the plug surface channels to form an array of gas distribution passages. Provision of the longitudinally-extending slots in the lateral surface of the plug and shrinking the metallic sleeve tightly on the plug body assures a unitized structure, however, there has been a problem in the formation of such devices and maintaining a smooth symmetrical exterior configuration because of the tendency of the thin-walled metal shell to deform inwardly toward the plug slots and thus create a wavy and uneven shell outer surface which will not register smoothly and contiguously within the opening or socket provided in the refractory block of the ladle. Moreover, blockage of the outlet ends of the passages by molten metal, although less of a problem than with permeable or porous plug bodies, nevertheless occurs in these devices.

Yet another attempt at resolving the problems of the prior art is disclosed in U.S. Pat. No. 4,938,461, which relates to an impervious refractory plug clad in a metal canister which is provided with an array of narrow peripheral passages formed in the lateral surface of the plug. These passages are defined by slots which are pre-formed in the peripheral surface of the plug as well as in the inner surface of the tightly fitting canister. An elongated metal strip, preferably of stainless steel is located in each passage to constitute heat sink elements which act to induce solidification of any molten metal which may tend to flow into the output ends of the passages when the gas is not flowing.

Despite these improvements, there still remains a need for ceramic plugs which are capable of providing gas to a molten metal vessel without experiencing plugging by solidified metal, and which can be made available in a variety of shapes and sizes to fit the particular end uses. In addition, a simplified method for making such ceramic plugs would be desirable.

SUMMARY OF THE INVENTION

The present invention relates to an insert member comprising a plurality of strand members having first and second ends and being oriented in a relative spatial relationship representative of a predetermined path, first means for mounting the first ends of the strand members and second means for mounting the second ends of the strand members. The first and second means are separated by a predetermined distance to provide the predetermined spatial relationship of the strand members. Generally, the first and second strand mounting means comprise end members which are configured, dimensioned and positioned to receive and retain the ends of the strand members.

To facilitate manufacture of the insert member, a predetermined number of strand members may be connected at their first and second ends to provide a cross-member which extends between the first and second mounting means with the predetermined number of strand members being less than the plurality of strand members in the insert member. The first and second end members may include slots with the first and second ends of each of the cross-members being received in the slots of the first and second strand mounting means. Thus, the first and second ends of the cross-members are conveniently received by the first and second strand mounting means and can be secured to the slots by an adhesive, such as contact cement, beeswax, or paraffin.

Alternatively, the end members can comprise a first portion which includes apertures for receiving the ends of the strand members, and a second portion which is secured to the first portion to retain the ends of the strand members therebetween. In this embodiment, the first end member portion may be made of a first thermoplastic material and the second end member portion may be made of a second thermoplastic material which is secured to the first end member portion.

The end portions and strands of the insert are each made of a relatively low melting thermoplastic or hydrocarbon material, such as a thermoplastic or paraffin, which can be vaporized at elevated temperatures without leaving any significant amount of residues. Preferably, the strand members are attached to the end members and each end portion includes an aperture for mounting to a support.

The invention also relates to a combination for making a ceramic gas distribution device comprising the insert member described above and a first ceramic in an unfired or green state cast partially therearound. Preferably, the first ceramic material surrounds the first mounting means and a portion of the strand members. Also, a second ceramic in an unfired or green state can easily be cast around a portion of the length of the strand members and adjacent the first ceramic. Instead, the first ceramic material can be cast around substantially the entire length of the strand members.

Yet another embodiment of the invention relates to a method for making a ceramic gas distribution device by preparing the insert material described above, casting a ceramic about the insert material, allowing the cast ceramic to set to an unfired or green state, and firing the ceramic material to its final shape while vaporizing the insert material to form gas passages within the ceramic gas distribution device.

Alternatively, this method could include preparing the combination described above, or placing a plurality of strand members in a predetermined orientation representative of a plurality of gas passages, casting a first ceramic about the strand members, and allowing the cast ceramic to set to an unfired or green state, prior to firing the ceramic to its final state.

The strand members may be configured to provide a gas discharge port for the gas passage having a size, shape and configuration which does not allow substantial penetration by molten metal therein. Also, metal strips may be provided within each passage to assist in the prevention of blockage of the passage by solidified metal. Advantageously, the strand members can be held in a predetermined arrangement prior to casting the ceramic therearound. To do this, tension may be applied to the strand members to provide a substantially parallel arrangement prior to casting.

The strand members are advantageously provided with end holding means, the end holding means can be configured in the shape of gas plenum, and the ceramic cast around a portion of the length of the strand members and the holding means to provide gas passages connected to a gas plenum in the device. To compensate for differences in the degree of thermal expansion between the insert material and the ceramic, a coating of a hydrocarbon wax can be provided on the end members. This coating would melt and vaporize before the end members to provide space to accommodate the greater expansion of the end members. Before firing the ceramic, the portions of the strand members which are not embedded in the cast ceramic can be trimmed and removed, if desired. After firing, a casing can be provided about the outside of at least a portion or substantially all of the device.

The invention also relates to a gas distribution device formed by the above described methods. This device generally comprises a three dimensional ceramic shape having at least first and second sides and a plurality of gas passages extending from a gas supply on the first side of the shape to a plurality of gas discharge ports on the second side of said shape. Preferably the size, shape and cross-sectional area of each gas discharge port in the second side of the ceramic shape has a cross-sectional area of sufficient dimensions to prevent substantial penetration of molten metal thereinto. If desired, a metal strip may be provided in each of the gas passages to assist in the prevention of blockage of the passage by solidified metal.

Advantageously, the ceramic shape is frusto-conical and the first side is opposite the second side, so that the plurality of gas passages are oriented substantially parallel to each other. Also, the first side of the device may include a plenum for distributing the gas into the passages.

If desired, each of the passages can have a relatively wider cross-sectional area at the first side of the shape and a relatively narrower cross-sectional area at the discharge port at the second side of the shape. For certain applications, a casing may be provided around a portion of the periphery of the device. If desired, the casing can be provided substantially around the entire periphery of the device.

As noted above, the invention contemplates utilizing one or more different ceramics in the device. For example, a first ceramic may be provided around and adjacent the gas discharge ports and a second ceramic adjacent the first ceramic.

BRIEF DESCRIPTION OF THE DRAWINGS

Structural characteristics of the plug device of the present invention and its operational features and advantages will become apparent from the ensuing detailed description, particularly when read with reference to the following drawing figures which illustrate preferred embodiments of the device and wherein.

DETAILED DESCRIPTION OF THE INVENTION

The present invention achieves the above identified advantages by forming a ceramic plug member or bubbler device with a plurality of passages that allow a gas such as argon to pass therethrough and be introduced, for example, into a molten bath of metal. This plug member is generally made by initially preparing an insert member which defines the passages, casting a ceramic material about the insert member, trimming portions of the insert member which extend outside of the cast ceramic material while the cast material is in a green state, if necessary, and firing the cast ceramic material to melt or vaporize the insert member and thus provide the gas passages in the final ceramic plug member.

In a first embodiment of the invention, an insert member 100 as illustrated in FIGS. 1–4 is initially prepared. This insert member 100 includes substantially square end portions 105, 110 of sufficient thickness to receive cross-members 120. Other shapes and sizes can be used for these end portions, depending upon the desired configuration of the plug member. Each cross-member 120 is preferably made from a rectangular sheet of plastic material that has a width of no greater than about 0.5 millimeters.

The width of this sheet is selected such that the gas passages formed therefrom prevent any molten metal in the vessel from entering to any significant extent during periods of time when gas is not flowing through the passages, such as during shutdowns or the like. Thus, when processing resumes, the molten metal which contacts the end of the plug member will remelt any solidified metal upon or within the end of the gas passages so as to reopen those passages and allow gas to again flow into the molten metal.

Figure 5:
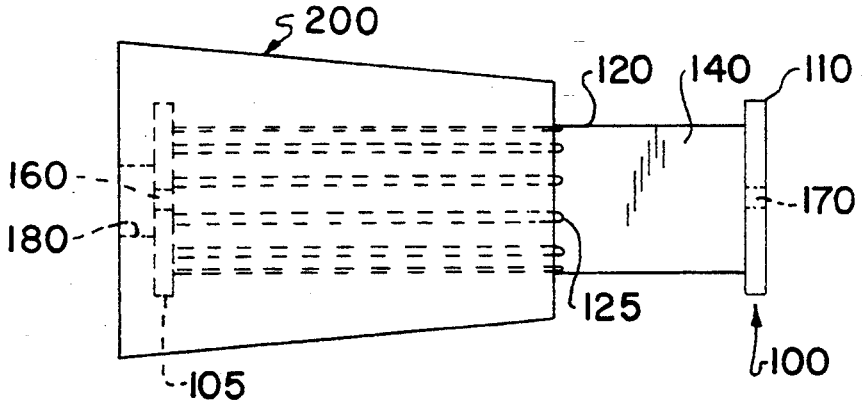
FIG. 5 is a ceramic material which has been cast around the insert member of FIG. 1 before the cast material is fired.
Figure 2:
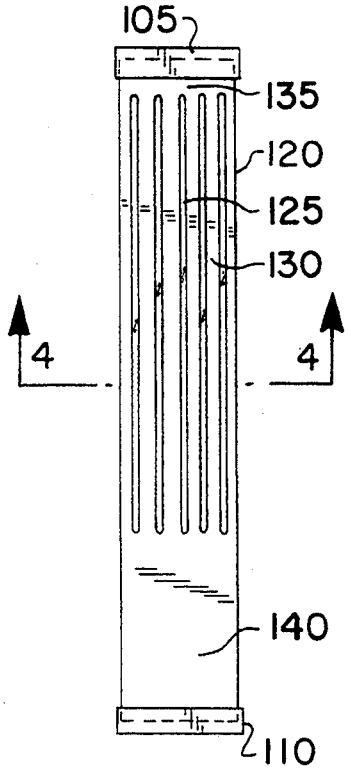
FIG. 2 is a front view of the insert member of FIG. 1.
Figure 3:
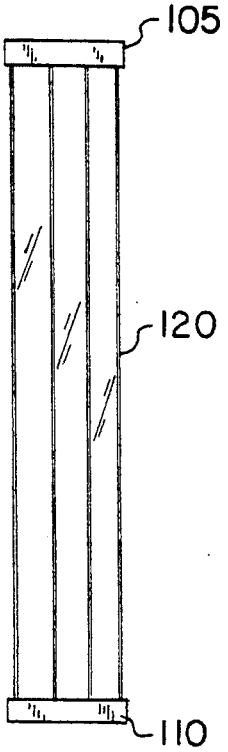
FIG. 3 is a side view of the insert member of FIG. 1.

Within the rectangular material of cross-member 120, elongated notches 125 are cut out to define a plurality of strands 130 which are used to form the passages in the ceramic plug member. This particular insert 100 is utilized to make generally elongated passages having a rectangular cross section. A plurality of cross-members 120 are provided to impart the desired number of passages in the plug member. The notches 125 are configured to be sufficiently long to extend out of the end or top portion of the ceramic member 200 which is to be cast around the insert member 100, as shown in FIG. 5. However, each end of the cross-member includes a relatively uncut area 135, 140 to facilitate positioning and attachment to the end portions 105, 110 of the insert member 100.

Figure 4:
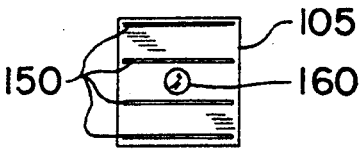
FIG. 4 is an view of the insert member of FIG. 8 taken along lines 4—4 of FIG. 2.

The specific connections between the cross-members 120 and end portions 105, 110 are made as follows. On one face of each of the end portions, a number of score lines 150 are provided therein. FIG. 4 illustrates these score lines 150 on end portion 105. The score lines are equivalent in number to the number of cross-members to be utilized. Although shown in the FIG. 4 as being within the perimeter of the end portions, the only requirement on the length and width of the score lines is that they can snugly receive the ends of the cross-members therein.

After scoring the end portions, one end of a cross-member is inserted into the scored area and is retained therein. To assist in securing the cross-members to the end portions, an adhesive, such as contact cement, can be used. If desired, other adhesives or materials that can bond both to the cross-members and the end portions, such as beeswax, paraffin, or the like, can instead be used. Preferably, the adhesive as well as each of the materials used in the formation of the insert member will be an organic material such as a thermoplastic or hydrocarbon material so that it will be vaporized during the firing of the plug material to obtain the voids and passages therein.

Figure 1:
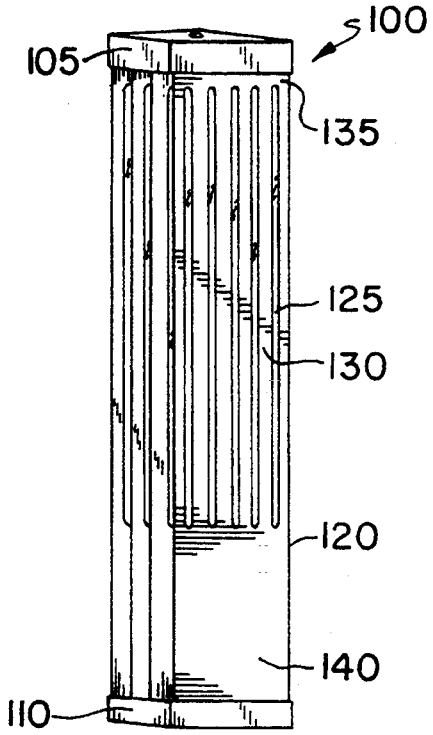
FIG. 1 is a perspective view of an insert member for use in making a ceramic plug member according to the present invention.

The remaining cross-members are inserted into the respective score lines on the end portions in the same manner described above. After one end portion is provided with the desired number of cross-members, the other end portion is attached to the opposite end of the cross-members in a similar fashion. As shown in FIG. 1, the cut-out portions of the cross-members are aligned so that they provide a uniform arrangement at one end of the insert, namely the end which is to be provided with cast ceramic material therearound.

Each end portion 105, 110 of the insert member 100 is provided with an alignment aperture 160, 170 which is generally threaded so that it may receive a mounting bolt. Thus, each end portion of the insert may be attached to a respective support plate in a manner such that the cross-members 120 are placed under a tension sufficient to align the strands 130 parallel with respect to each other and in a substantially perpendicular orientation with respect to the end portions. Also, the mounting bolts may form part of the casting mold into which the insert member is placed.

While this arrangement of strand members is preferred, it is not absolutely required to practice the present invention. It is also possible to utilize any arrangement of strands which provides passages in the ceramic material that allow gas to be directed from one end of the plug member to the other. Also, although discrete, unidirectional passages are preferred with regard to the pressure drop therethrough, it is also possible to allow the passages to contact or intersect each other as long as the gas can pass through the plug member from one end to another. These arrangements allow the plug member to have better structural integrity compared to porous ceramic materials.

According to the preferred mode, after properly aligning or tensioning the insert material, it is placed in a mold and a castable ceramic material is placed therearound to cover the first end portion 135 and the strand members 125, but, generally, to not cover the second end portion 110 and the second ends 140 of the cross-members 120. After the ceramic has gelled or set to a so called green state, it is removed from the mold and appears as shown in FIG. 5. At this point in the process, portions of the insert member which are not embedded in the ceramic can be trimmed. In particular, the second end of the insert i.e., the second end portion 110 and the second ends 140 of the cross-members 120 may be removed by cutting, thus providing a green ceramic material 200 having the strand members 125 and first end portion 105 of the insert member 100 embedded therein. This combination is then taken and placed in a furnace or other appropriate heating vessel to fire the ceramic material to its desired final state, thus forming the plug member with gas passages therein.

To assist in the distribution of the gas into the gas passages of the plug member 200, a gas plenum 180 may be provided in the base of the plug member which will be connected to a supply of gas. This plenum 180 uniformly distributes the gas between and among the passages, so that all passages receive gas for transport through the plug member and to the opposite end for exit into the molten metal. Instead of a plenum, the end of the plug member could be designed with a flat face for engaging a exit plenum of a gas generating or gas supply apparatus. Distribution of the gas is easily made by the appropriate pressure placed on the gas adjacent the passages or in plenum 180, as would be known by those skilled in the art of gas transport.

It is of course, up to the person skilled in the art to select a desired ceramic material which can be used to form the plug members of this invention, and there is no criticality in the type of ceramic used. Furthermore, one skilled in the art would know the appropriate firing temperatures to be used for any particular ceramic that is selected. Generally, alumina, silica and mixtures thereof are preferred for applications where the plug member will contact molten metals such as iron, steel and alloys thereof.

As noted above, it is important that the end portions 105, 110, adhesive and cross-members 120 of the insert material 100 be selected to be of a thermoplastic which has a sufficiently low melting temperature so that it would be vaporized during the firing process to provide the appropriate passages in the insert material without leaving any significant residues which would block these passages. Generally, waxes such a paraffin waxes, thermoplastics such as polyethylene and polypropylene and copolymers thereof, and other relatively low temperature thermoplastics such as polystyrene can be used in this invention. A preferred plastic material for the strand or cross-members and the end members is an ultra-high molecular weight polyethylene such as TIVAR 100, which is available from Poly-hi Corporation, Ft. Wayne, Ind. Other thermoplastics could also be used, as the only requirements on this material are that it can be cut, extruded or molded into the desired configuration and that it will vaporize due to thermal degradation when the ceramic material is fired to create the gas passages therein, without leaving a significant amount of residues which would block the passages in the plug member.

It has been found that certain thermoplastics have a greater thermal expansion coefficient than that of the ceramic. To compensate for the different amount of expansion of the plastic of the end members when the ceramic is fired, a coating of paraffin or other relatively lower melting temperature hydrocarbon wax can be placed on the end member that is embedded in the ceramic. Typically, a 1/16" thick coating is sufficient to prevent cracking of the ceramic due to the greater expansion of the thermoplastic end members during firing of the ceramic. This thickness provides sufficient coating material which would melt and vaporize prior to the thermoplastic end member to provide space which will accommodate the expansion of the end member.

Figure 6:
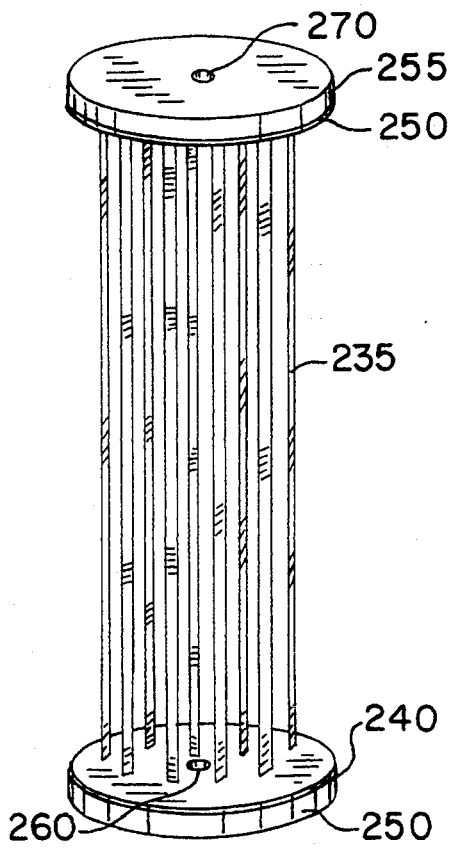
FIG. 6 is a perspective view of a second insert member according to the present invention.

A second embodiment of an insert member for use in the present invention is illustrated in FIG. 6. This insert member 225 is for use in preparing a slightly different plug member or bubbler device and is prepared as follows. Initially, a plurality of strand members 235, again of thickness of no greater than 0.5 millimeters and of a predetermined number and width to provide a desired gas flow through the plug member, are made by extrusion or cutting of thermoplastic film stock. Again, the TIVAR material is used. First and second relatively thin disk members 240, 250 of the same thermoplastic material are prepared by cutting to the desired circumference and scoring to provide a plurality of slots therein with each slot adapted to accommodate one end of a strand member. Thus, the number of slots of each of the first and second disks 240, 250 is equal to the number of strand members 235 which will be utilized in the insert member 225. The back sides of these disks are provided with contact cement, and the ends of each of the strand members 235 are placed into its respective scored slot in the first and second disks 240, 250 and are folded over onto the cement on the back portion of each of the disks. Thereafter, end portions 245, 255 are integrally bonded both to the ends of the strands 235 and to the back of the disks 240, 250 by the contact cement to securely hold the strand members 235. Before assembly, each disk and end portion is machined to the appropriate size and shape which, as shown in FIG. 6, is preferably a circular disk. The assembly is then provided with a threaded mounting aperture 260, 270 similar to that which is discussed above with respect to the end portions 105, 110 of insert member 100 of FIGS. 1–4.

After mounting insert member 225 in the mold, such as by attachment of the disk members through the mounting apertures 260, 270 to mounting means (not shown) and application of the appropriate alignment or tension forces as desired, a castable ceramic is then introduced into the mold in an amount sufficient to surround one end of the insert and extend along a desired height of the strands 235. In this embodiment, the height of the ceramic plug member is not limited to any particular degree except that it generally would not extend beyond the second end portion 255 of insert member 225, so that the top surface of the plug member would be provided with the ends of the gas passageways after firing.

After the ceramic material has set or achieved a green state, the second disk member 250, and end portion 255 and a portion of the strands are cut away from the embedded strands, and the ceramic material is removed from the mold and placed in an appropriate furnace for firing. Again the final plug member 280 will have a plurality of unidirectional gas passages 285 extending from one end to the other.

Figure 7:
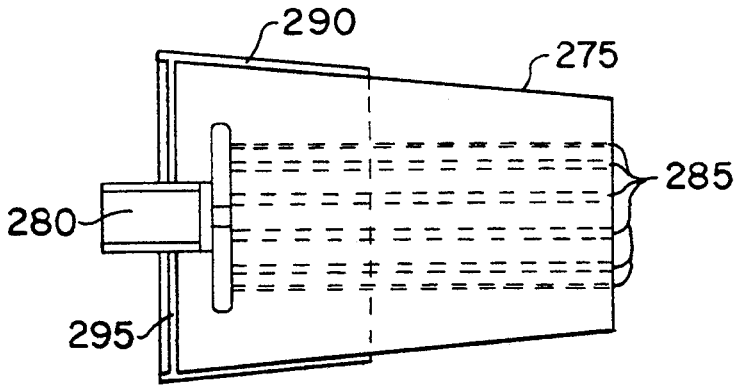
FIG. 7 is a side view of the final ceramic plug member formed from the insert of FIG. 6 in a metal casing support.

The fired ceramic plug member 275 may optionally be provided with a metal casing. This casing is made by forming a metal cylinder 290 to the approximate outer dimensions of the plug, heating the cylinder to an appropriate elevated temperature to expand its size and allow placement of the ceramic plug member 275 therein, and welding a base member 295 to the metal cylinder to provide the casing. As shown in FIG. 7, the casing may extend only partially along the height of the plug. If desired, the casing may extend along the entire height of the plug member. Another procedure for providing a full height casing is similar to that disclosed in U.S. Pat. No. 4,938,461.

In the embodiment of FIG. 7, the first end portion of the insert member provides a gas plenum 280 in the base of the plug member, and a casing is included. A nozzle may be welded to the base of the casing and then connected to the source of gas to supply such gas to the plenum. While in the currently preferred mode of operation, a plenum within the plug member is desirable, it is recognized that this plenum is optional and can be provided at the end of the gas source rather than in the plug member itself.

Also, the gas passages do not necessarily have to be parallel nor do they have to be of a generally elongated rectangular shape. When cylindrical gas passages are desired, it is advantageous for at least the gas discharge ports of the passages to have a diameter which is less than about 0.5 millimeters, because this prevents the penetration of molten metal into the exposed end of the passageway to any significant depth. As noted above, this becomes important during shutdown or other temporary discontinuance of the introduction of gas into the molten metal bath. If the metal penetrates into the passageways to a depth which will be remelted upon introduction of a new quantity of molten metal into the vessel upon startup, the passages do not become blocked by solidified metal. Thus, one skilled in the art can devise numerous configurations for the cross sectional shape of the gas passages to achieve an appropriate design which does not allow plugging by solidified metal by including at least one cross-sectional dimension which is less than 0.5 millimeters.

In addition, when parallel passages are utilized, plugging of the ends of the passages by solidified molten metal can be substantially prevented by the use of a heat sink concept similar to that described in U.S. Pat. No. 4,938,461. For this embodiment, the passages are made with a larger cross-sectional area than necessary for distribution of the gas, and an elongated metal strip, preferably stainless steel, is provided in each of the slots.

These strips extend substantially the full length within the slots, and include end tabs which overlie the surface of the base end of the plug as shown in U.S. Pat. No. 4,938,461, the content of which is expressly incorporated herein by reference thereto to illustrate this feature of the invention. Each strip occupies about one-third to one-half of the available area of the slot. One skilled in the art can easily select the appropriate size of the strand members so that the slots are made of sufficient size to accomodate the metal strip and have sufficient area remaining to provide the desired gas flow therethrough.

Furthermore, the passages do not have to be parallel and may take any path which directs the gas from one end of the plug member to the other. In this regard, it is noted that the present invention provides substantial advantages over a porous ceramic material in that the flow of the gas through the plug is preferably unidirectional in that it enters one end of the plug and exits the opposite end of the plug member. It is also possible for the gas passages to extend through a cube or box-shaped plug member, for example, from one side to an adjacent side. Generally, a plurality of parallel, spaced substantially straight gas passageways are preferred because they provide the lowest pressure drop across the plug member.

Instead of the plenum area described above, it is also possible to design each of the passages to be wider at the base of the plug and generally tapering or otherwise constricting as they extend through the plug member to the gas outlets. Thus, each passage effectively includes its own plenum. Such configurations are easily achieved by providing the appropriate shape made out of either plastic or a hydrocarbon waxes and then casting the ceramic material around the plurality of these shapes to form the passages after firing of the ceramic.

By correctly selecting the cross-sectional area of the passages, a predetermined gas flow can be provided into the molten metal bath. Compared to prior art devices of the same size, the present invention can provide substantially increased gas flow rates due to the particular manufacturing technique of providing passages therein.

As previously noted above, the plug members of the invention may be placed within a metal casing if desired. However, it is possible to utilize the plug member by itself as the gas distribution device. Because of the versatility in casting ceramics to a wide variety of shapes, designs or configurations. It is contemplated that the present invention will replace numerous gas distribution devices which are presently made of number of component parts. For example, a typical device of the prior art might include two ceramic portions, one of which fits within the other at a spaced distance to provide the gas distribution passageways, with the entire assembly fitted within a casing or other type of housing. In addition, other prior art devices have included numerous metallic inserts within the ceramic plug member and are also mounted in a housing. These housings are then placed into a receiving cavity on a ladle, tundish or other molten carrying vessel. For some situations the plug member is grouted into place or otherwise retained in an appropriate opening in these molten metal containing devices.

The present invention simplifies such constructions as it allows for a single ceramic member having the predetermined number of gas passages therein to be inserted or grouted directly into the appropriate chamber without the need for casings or other peripheral supports. As noted above, it is also possible to directly cast a ceramic material into the desired configuration, and to provide the casting with any of a wide variety of gas passages or cross-sectional areas therefor by utilizing appropriately prepared insert members according to the present invention. If desired, two or more different ceramics can be cast around the insert member to form the plug member. For example, a more resistant ceramic can be used for the portion of the plug member that contacts the molten metal in the vessel, while the other portions can be made of a different ceramic. In addition to simplifying the prior art systems, a more reliable construction can be achieved rapidly and in an economical manner.

It is anticipated that modifications or variations may hereafter be made which depart from the specific structure illustrated with reference to the preferred embodiment in the accompanying drawings, and it is intended that all such modifications or equivalent variations be included within the scope of the appended claims.

What is claimed is:

1. An insert member for use in making a plug member comprising a plurality of non-intersecting strand members having first and second ends and being oriented in a substantially parallel relationship representative of a desired path, first mounting means for mounting the first ends of the strand members and second mounting means for mounting the second ends of the strand members, said strand members and said first and second mounting means each being made of a thermoplastic or hydrocarbon material, and wherein at least one of the first and second mounting means includes a coating of a hydrocarbon material which has a lower melting point than that of the said at least one mounting means.

2. The insert member of claim 1 wherein the first and second strand mounting means each include end members which are configured, dimensioned and positioned to receive and retain the ends of the strand members.

3. The insert member of claim 1 wherein a desired number of strand members are connected at their first and second ends to provide a cross-member which extends between the first and second mounting means and wherein the desired number of strand members is less than the plurality of strand members in the insert member.

4. The insert member of claim 3 wherein the first and second mounting means include slots and the first and second ends of each of the cross-members are received in the slots of the first and second strand mounting means.

5. The insert member of claim 4 wherein the ends of the cross-members are secured to the slots by an adhesive.

6. The insert member of claim 5 wherein the adhesive is contact cement, beeswax, or paraffin.

7. The insert member of claim 2 wherein the end members each comprises a first portion which includes apertures for receiving the ends of the strand members.

8. The insert member of claim 7 wherein the end members each further comprises a second portion which is secured to the first portion to retain the ends of the strand members therebetween.

9. The insert member of claim 8 wherein the first end member portion is made of a first thermoplastic material and the second end member portion is made of a second thermoplastic material which is secured with an adhesive to the first end member portion.

10. The insert member of claim 1 wherein the strands are made of a thermoplastic material and the end members are made of a hydrocarbon.

11. The insert member of claim 2 wherein the strand members are attached to the end members with an adhesive.

12. The insert member of claim 2 wherein each end member includes an aperture for mounting to a support.

13. A plug member for use in making a ceramic gas distribution device comprising an insert member comprising a plurality of non-intersecting strand members having first and second ends and being oriented in a substantially parallel relationship representative of a desired path, first means for mounting the first ends of the strand members and second means for mounting the second ends of the strand members, said strand members and said first and second mounting means each being made of a thermoplastic or hydrocarbon material, and a first ceramic in an unfired or green state disposed at least partially around the strand members and one of the mounting means, and wherein at least the mounting means which is disposed at least partially within the ceramic includes a coating of a hydrocarbon material which has a lower melting point than that of the mounting means.

14. The plug member of claim 13 wherein the first ceramic material surrounds the first mounting means and a portion of the strand members.

15. The plug member of claim 14 further comprising a second ceramic in an unfired or green state disposed around a portion of the length of the strand members and adjacent the first ceramic.

16. The plug member of claim 14 wherein the first ceramic material is disposed around substantially the entire length of the strand members.

17. A plug member for making a ceramic gas distribution device comprising the insert member of claim 3 and a first ceramic in an unfired or green state disposed around the first holding means and along and about a substantial portion of the length of the strand members.

18. A method for making a ceramic gas distribution device which comprises:

preparing an insert member for use in making a plug member comprising a plurality of non-intersecting strand members having first and second ends and being oriented in a substantially parallel relationship representative of a desired path, first means for mounting the first ends of the strand members and second means for mounting the second ends of the strand members, said strand members and said first and second mounting means each being made of a thermoplastic or hydrocarbon material which can be vaporized during firing of the plug member so as to provide gas passages therein;

casting a ceramic material about at least a portion of the strand members and one of the mounting means;

allowing the cast ceramic material to set to an unfired or green state; and firing the ceramic material to its final shape while vaporizing the insert member to form a ceramic gas distribution device having passages extending therethrough and a gas plenum at one end.

19. A method for making a gas distribution device which comprises:

preparing a plug member for use in making a ceramic gas distribution device, said plug member including an insert member comprising a plurality of non-intersecting strand members having first and second ends and being oriented in a substantially parallel relationship representative of a desired path, first means for mounting the first ends of the strand members and second means for mounting the second ends of the strand members, said strand members and said first and second mounting means each being made of a thermoplastic or hydrocarbon material which can be vaporized during firing of the plug member so as to provide a plenum and gas passages therein, and a first ceramic in an unfired or green state disposed at least partially around the strand members and one of the mounting means; and firing the ceramic material to its final shape while vaporizing the insert member to form a ceramic gas distribution device having gas passages extending therethrough and a gas plenum at one end.

20. A method for making a ceramic gas distribution device which comprises:

preparing an insert member for use in making a plug member comprising a plurality of non-intersecting strand members having first and second ends and being oriented in a substantially parallel relationship representative of a desired path, first means for mounting the first ends of the strand members and second means for mounting the second ends of the strand members, said strand members and said first and second mounting means each being made of a thermoplastic or hydrocarbon material which can be vaporized during firing of the plug member so as to provide a plenum and gas passages therein, and a first ceramic in an unfired or green state disposed at least partially around the strand members and one of the mounting means, wherein the first ceramic material surrounds the first mounting means and a first portion of the strand members, and a second ceramic in an unfired or green state disposed around a second portion of the length of the strand members adjacent the first ceramic; and firing the ceramic material to its final shape while vaporizing the insert member to form a ceramic gas distribution device having gas passages extending therethrough and a gas plenum at one end.

21. A method for making a ceramic gas distribution device which comprises:

preparing an insert member for use in making a plug member comprising a plurality of non-intersecting strand members having first and second ends and being oriented in a substantially parallel relationship representative of a desired path, first means for mounting the first ends of the strand members and second means for mounting the second ends of the strand members, said strand members and said first and second mounting means each being made of a material which can be vaporized during firing of the plug member so as to provide a plenum and gas passages therein, wherein at least some of strand members are connected at their first and second ends to provide a cross-member which extends between the first and second mounting means, and a first ceramic in an unfired or green state cast around the first mounting means and along and about a substantial portion of the length of the strand members; and firing the ceramic material to its final shape while vaporizing the insert member to form a ceramic gas distribution device having gas passages extending there through and a gas plenum at one end.

22. A method for making a ceramic gas distribution device which comprises;

placing a plurality of non-intersecting strand members in a substantially parallel orientation representative of a plurality of gas passages;

providing said strand members with end holding means;

configuring said end holding means in the shape of a gas plenum, wherein each of said strand members and end holding means is made of thermoplastic or hydrocarbon material;

casting a first ceramic at least partially about the strand members and one of the end holding means to provide gas passages connected to a gas plenum in the device;

allowing the cast ceramic to set to an unfired or green state; and firing the ceramic material to a final state while vaporizing the strand members and end holding means material therein to thus provide a ceramic gas distribution device having gas passages extending therethrough and a gas plenum at one end.

23. The method of claim 22 which further comprises configuring the strand members to provide an exit of the gas passage with a size, shape and configuration which does not allow substantial penetration by molten metal therein.

24. The method of claim 22 which further comprises applying tension to the strand members to provide a substantially parallel arrangement prior to casting the ceramic therearound.

25. A method for making a ceramic gas distribution device which comprises:

placing a plurality of strand members in a orientation representative of a plurality of gas passages;

providing said strand members with end holding means;

configuring said end holding means in the shape of a gas plenum, wherein each of said strand members and end holding means is made of thermoplastic or hydrocarbon material;

casting a first ceramic at least partially about the strand members and one of the end holding means to provide gas passages connected to a gas plenum in the device;

allowing the cast ceramic to set to an unfired or green state;

firing the ceramic material to a final state while vaporizing the strand members and end holding means material therein to thus provide a ceramic gas distribution device having gas passages extending therethrough and a gas plenum at one end; and providing metal strips within each passage to assist in the prevention of blockage of the passage by solidified metal.

26. The method of claim 22 which further comprises providing a coating on the end holding means to compensate for differences in the degree of thermal expansion between the insert material and the ceramic, and melting and vaporizing the coating to provide space to accommodate the greater expansion of the end holding means.

27. The method of claim 22 which further comprises trimming the portions of the strand members which are not embedded in the cast ceramic.

28. The method of claim 22, which further comprises providing a casing about the outside of at least a portion of said device.

29. A gas distribution device consisting essentially of a three dimensional ceramic shape having at least first and second sides, a plurality of gas passages extending from a gas supply on the first side of the shape to a plurality of gas discharge ports on the second side of said shape, wherein the size, shape and cross-sectional area of each discharge port in the second size of the ceramic shape has a cross-sectional area of sufficient dimensions to prevent substantial penetration of molten metal thereinto, and on the first side of the device, a plenum for distributing gas into said passages; wherein each of the passages has a wider cross-sectional area at the first side of the shape and a relatively narrower cross-sectional area at the discharge port at the second side of the shape.

30. The device of claim 29 wherein the ceramic shape is frusto-conical and the first side is opposite the second side.

31. The device of claim 29 wherein the plurality of gas passages are oriented substantially parallel to each other.

32. A gas distribution device consisting essentially of a three dimensional ceramic shape having at least first and second sides, a plurality of gas passages extending from a gas supply on the first side of the shape to a plurality of gas discharge ports on the second side of said shape, wherein the size, shape and cross-sectional area of each discharge port in the second size of the ceramic shape has a cross-sectional area of sufficient dimensions to prevent substantial penetration of molten metal thereinto, a plenum on the first side of the device for distributing gas into said passages; and a metal strip in each of the gas passages to assist in the prevention of blockage of the passage by solidified metal.

33. The device of claim 29 further comprising a casing around a portion of the periphery of the device.

34. The device of claim 29 further comprising a casing substantially around the entire periphery of the device.

35. The device of claim 29 wherein at least two different ceramics are present.

36. The device of claim 29 wherein a first ceramic is provided around and adjacent the gas discharge ports and a second ceramic is provided adjacent the first ceramic.

37. The method of any one of claims 18–22 which further comprises providing the gas plenum within the ceramic gas distribution device.

* * * * *